US006042008A

United States Patent [19]

Ando et al.

[11] Patent Number: 6,042,008

[45] Date of Patent: Mar. 28, 2000

[54] TOLL COLLECTION SYSTEM OF TOLL ROAD AND IN-VEHICLE UNIT FOR THE SAME

[75] Inventors: Toshihide Ando, Chita-gun; Asako Maeda, Tokai; Tomoaki Mizuno, Toyoake, all of Japan

[73] Assignee: Denso Corporation, Kariya, Japan

[21] Appl. No.: 08/886,453

[22] Filed: Jul. 1, 1997

[30] Foreign Application Priority Data

Jul. 1, 1996 [JP] Japan ..... 8-171064

[51] Int. Cl.[7] ..... G07B 15/02

[52] U.S. Cl. ..... 235/384; 235/375; 235/380; 235/381; 235/492; 235/472; 340/928; 340/933; 340/942; 340/51

[58] Field of Search ..... 235/384, 375, 235/380, 381, 492, 472; 340/928, 933, 942, 51

[56] References Cited

U.S. PATENT DOCUMENTS

| | | | |
|---|---|---|---|
| 3,705,976 | 12/1972 | Platzman | 235/61.7 |
| 4,493,103 | 1/1985 | Yamashita et al. | 382/1 |
| 4,682,170 | 7/1987 | Kubota et al. | 340/928 |
| 4,908,500 | 3/1990 | Baumberger | 235/384 |
| 4,963,723 | 10/1990 | Massada | 235/384 |
| 5,101,200 | 3/1992 | Swett | 340/937 |
| 5,173,692 | 12/1992 | Shapiro et al. | 340/943 |
| 5,313,295 | 5/1994 | Taniguchi et al. | 348/149 |
| 5,648,767 | 7/1997 | O'Connor et al. | 340/928 |
| 5,777,565 | 7/1996 | Hayashi et al. | 340/928 |

FOREIGN PATENT DOCUMENTS

| | | |
|---|---|---|
| 58-72286 | 4/1983 | Japan . |
| 58-192191 | 11/1983 | Japan . |
| 58-205299 | 11/1983 | Japan . |
| 59-223891 | 12/1984 | Japan . |
| 61-270194 | 11/1986 | Japan . |
| 62-154096 | 7/1987 | Japan . |
| 63-127392 | 5/1988 | Japan . |
| 64-76292 | 3/1989 | Japan . |
| 3-48986 | 3/1991 | Japan . |
| 3-154989 | 7/1991 | Japan . |
| 4-242497 | 8/1992 | Japan . |
| 5-197856 | 8/1993 | Japan . |

*Primary Examiner*—Thien M. Le
*Assistant Examiner*—Daniel S. Felten
*Attorney, Agent, or Firm*—Pillsbury Madison & Sutro LLP

[57] ABSTRACT

To ensure the toll collection of a vehicle carrying an in-vehicle unit without stopping the vehicle at an entrance toll gate or an exit toll gate, an entrance toll gate lane is equipped sequentially from the entrance with a vehicle class discriminator, an entrance vehicle number reader, a first antenna, a vehicle detector, a ticket issuer, a display unit, a vehicle detector, a second antenna and a start detector. The first antenna communicates with an in-vehicle unit of a coming vehicle to write the entrance toll gate data. The display unit is caused, when the communication succeeds, to permit the passage of the vehicle therethrough. When the communication fails, the display unit is caused to stop the vehicle, and the ticket issuer issues the ticket. The second antenna writes the vehicle class data and the registered number data, as detected by the vehicle class discriminator and the vehicle number reader, in an in-vehicle unit. Thus, the existing facilities can be used as they are.

10 Claims, 11 Drawing Sheets

TOLL COLLECTION SYSTEM OF TOLL ROAD AND IN-VEHICLE UNIT FOR THE SAME

CROSS-REFERENCE TO RELATED APPLICATION

This application is related to Japanese Patent Application No. Hei 8-171064, incorporated herein by reference.

BACKGROUND OF THE INVENTION

1. Field of the Invention

The present invention relates to a toll collection system for a toll road which can perform toll collection transactions with a vehicle on the toll road without stopping the vehicle at a toll gate, and further relates to an in-vehicle unit for the toll collection system.

2. Description of Related Art

A toll collection system of this kind for a toll road is disclosed, for example, in Japanese Patent Publication Laid-Open No. Sho 63-127392. In this system, first and second on-road units are arranged sequentially in the advancing direction on the lanes of an entrance toll gate of a toll road, and a ticket issuer for issuing a ticket according to the toll is disposed behind the second on-road unit. In a passing vehicle, moreover, there is carried an in-vehicle unit which can communicate with those on-road units so that the toll is automatically collected by communicating with the passing vehicle.

In this construction, when a vehicle advances to the entrance toll gate, the first on-road unit communicates at first with the in-vehicle unit, as carried in the vehicle, to recognize the ID card of the vehicle. At this entrance toll gate, the clerk discriminates the vehicle class indicating the classification for calculating the toll. In the case of success in the communication by the first on-road unit, moreover, the second on-road unit then transmits the data of the entrance toll gate and the vehicle class data to the in-vehicle unit and causes that data to be written in the in-vehicle unit. Upon the failure of the communication by the first on-road unit, on the other hand, the entrance toll gate data is not recorded in the in-vehicle unit so that a ticket for the vehicle is issued by the ticket issuer so that the driver can receive it.

By providing this construction, when the vehicle carries the in-vehicle unit and operates in a normal state, it can pass without stopping at the entrance toll gate thereby reducing the complexity of the toll collection and reducing the traffic congestion at the entrance toll gate.

In the aforementioned construction, however, the vehicle class data are discriminated by manual means so that the discrimination takes considerable time. When the running speed of the coming vehicle exceeds a predetermined value, it may pass through before the completion of the communication of the vehicle class data and the entrance toll gate data by the second on-road unit. In other words, the running speed on the toll gate lanes has to be limited to a predetermined value or less so that the vehicle class data and the entrance toll gate data may be written without fail.

As the system for deciding the vehicle class data automatically, on the other hand, there is a vehicle class discriminator which is disposed at an entrance toll gate of an existing toll road. This discriminator is disposed at a position of about 20 meters on the entry side of the ticket issuer. Before the vehicle to pass passes through the vehicle class discriminator to the position of the ticket issuer and stops, the ticket issuer issues a ticket corresponding to the vehicle class as discriminated by the vehicle class discriminator.

Incidentally, this automatic vehicle class discriminator is arranged assuming that the vehicle stops at the position of the ticket issuer, as described above, so that the distance to the ticket issuer is set short. When the aforementioned toll collection system is to be applied, it is also impossible to retain the time period for the writing operation of the second on-road unit reliably.

SUMMARY OF THE INVENTION

The present invention has been conceived in view of the above problems of the prior art and has an object of providing a toll collection system for a toll road and an in-vehicle unit therefor, which reliably obtains entrance toll gate data.

It is another object of the present invention to provide a toll collection system for a toll road and an in-vehicle unit therefor, which can automatically reliably write vehicle class data in the in-vehicle unit.

It is a further object of the present invention to provide a toll collection system for a toll road and an in-vehicle unit therefor, which can use existing facilities of the toll gate of the toll road, e.g., vehicle class discriminators and ticket issuers, for performing such operations.

It is still another object of the present invention to provide a toll collection system for a toll road and an in-vehicle unit therefor, which can provide such advantages while ensuring accurate and reliable toll processing accounting operations.

The above objects are achieved according to a first aspect of the present invention by providing that as the vehicle carrying the in-vehicle unit advances to the entrance toll gate lane, communication is made at first by the first on-road unit, as disposed at the entrance position, and the vehicle class is discriminated by the vehicle class discriminator. At this time, the first on-road unit transmits the entrance toll gate data to the in-vehicle unit to cause it to write the data, so that it outputs the confirmation signal when the writing end signal is received from the in-vehicle unit. In this case, the in-vehicle unit of the coming vehicle confirms that the entrance toll gate data have been written, the coming vehicle need not receive the ticket from the ticket issuer located ahead, but can pass by with no action. Since the confirmation signal is thus outputted from the first on-road unit, the control means transmits the vehicle class data, as discriminated by the vehicle class discriminator to write them in the in-vehicle unit while the coming vehicle is passing through the communication area of the second on-road unit. As a result, the coming vehicle can store the entrance toll gate data and promptly advance to the main lanes without any stop at the entrance toll gate.

When the coming vehicle does not carry the in-vehicle unit or fails to communicate reliably, the first on-road unit cannot receive the writing end signal, even if the entrance toll gate data are transmitted to the coming vehicle in the course of the communication by the first on-road unit. As a result, the control means recognizes the failure in the communication and controls the coming vehicle to receive the ticket as in the system of the prior art with no communication. In this case, the control means causes the ticket issuer to issue the ticket corresponding to the vehicle class, as discriminated by the vehicle class discriminator. Then, the driver of the coming vehicle stops at the position of the ticket issuer to receive the ticket and advances to the main lanes.

As a result, when the in-vehicle unit is carried on the coming vehicle and is working in the normal state, the vehicle can advance promptly to the main lanes without any stop at the entrance toll gate, so that neither the toll collection nor the ticket reception need be required to contribute to eliminating the delay at the toll gate.

Further, as the vehicle advances to the entrance toll gate lane, in addition to the aforementioned operations, the registered number of the license plate of the coming vehicle is recognized by the coming vehicle number reader, and the registered number data are written in the in-vehicle unit. At least during the passage through the toll road, the vehicle carrying the in-vehicle unit can be specified so that the data can be effectively exploited for ensuring the toll collection.

Moreover, when the vehicle running on the main lane leaves it and enters the exit toll gate lane, the communication is made with the in-vehicle unit by the third on-road unit to calculate the toll on the basis of the data, as written at the entrance toll gate, so that the toll collection data can be written in the in-vehicle unit or that the corresponding account can be specified from the data of the ID code of the in-vehicle unit to settle the toll. As a result, even at the exit toll gate, the toll collection can be automatically effected when the passing vehicle carries the in-vehicle unit. Thus, neither any stop nor the complicated toll collection can be required to contribute to eliminate the traffic stagnation.

Further, as the vehicle enters the exit toll gate lane, the leaving vehicle number recognizer recognizes the registered number of the license plate of the vehicle, and the third on-road unit communicates with the in-vehicle unit of the vehicle to read the registered number, as written at the entrance toll gate, in addition to the foregoing operations so that the data are compared with the registered number, as recognized by the leaving vehicle number recognizer. This makes it possible to identify whether or not the vehicle passing through the toll road and the carried in-vehicle unit are identical. Thus, it is possible to recognize anomalous activity in which the in-vehicle unit is placed in the course on another vehicle, for example. At each time of passage through the toll road, the identification of the registered number is made to make it unnecessary to restrict the use of the in-vehicle unit to a specific vehicle, so that one in-vehicle unit can be commonly used among a plurality of vehicles.

Moreover, when the vehicle entering the entrance toll gate lane fails to carry the in-vehicle unit or to communicate normally because of trouble even while carrying the in-vehicle unit, the entrance toll gate data, as transmitted from the first on-road unit, cannot be written so that the control means cannot receive the confirmation signal from the first on-road unit. As a result, the control means causes the ticket issuer to issue the ticket and the display unit to request the driver to take the ticket. Thus, the driver of the vehicle can recognize the passage after reception of the ticket.

Further, the second on-road unit is arranged at the deepest position on the entrance toll gate lane to maximize the time period for the coming vehicle to pass through the area of the first on-road unit and to reach the area of the second on-road unit, so that the time period necessary for the midcourse operations can be retained. Moreover, these operations can be achieved without rearranging the existing facilities.

Moreover, the fourth on-road unit communicates with the in-vehicle unit being carried by a vehicle advancing from the main lanes to the exit toll gate. At this time, the fourth on-road unit calculates the toll up to that point by assuming that the vehicle will leave the toll road, and writes the data in the in-vehicle unit. As a result, when the vehicle reaches the exit toll gate lane, what is required is performance of the communication for confirming whether or not the calculation of the toll has already been ended by the third on-road unit. As a result, the vehicle can pass promptly through the exit toll gate lane when the communication by the fourth on-road unit was reliably performed.

Further, when the writing instruction was received from the fourth on-road unit so that the writing was done in the aforementioned case, it is decided by the decision means whether or not the writing has been reliably done. The driver can be informed of that result by the display means. As a result, the driver can be directed to recognize whether his vehicle will pass through an exclusive toll gate or advance to the manned toll gate.

Also, by writing entrance toll gate data in the in-vehicle unit using the first on-road unit, the toll is reliably computed at the exit gate if the writing succeeds. Also, even if the in-vehicle unit writing does not succeed, a toll gate attendant can compute the toll at the exit gate by retrieving the entrance toll gate data stored in the in-vehicle unit or can be computed in some other way. In contrast, if an attempt is made to write the entrance toll gate data using the second on-road unit as described in the aforementioned Japanese Patent Publication Laid-Open No. Sho 63-127392, the entrance point will not be properly identified if there is a writing error, thereby causing an error such as computation of the toll from the farthest point on the toll road.

Other objects and features of the present invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

A first preferred embodiment of the present invention will be described with reference to FIGS. 1–12.

Figure 1:
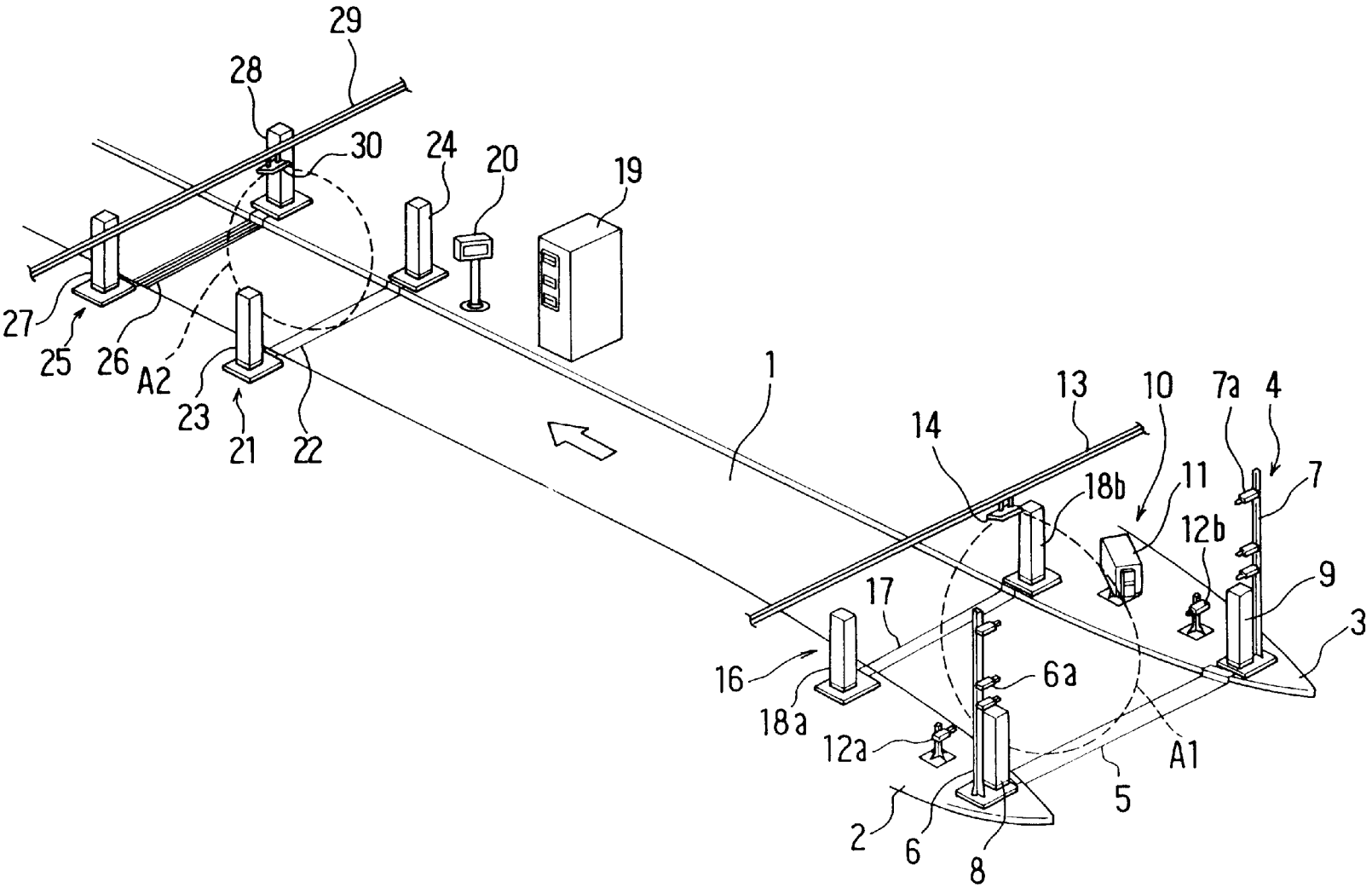
FIG. 1 is a perspective view showing an appearance of an entrance toll gate according to a first preferred embodiment of the present invention.

FIG. 1 shows the arrangement of the individual facilities of an ETCS (Electronic Toll Collection System) according to the present invention disposed at an entrance toll gate lane 1 of a toll road such as an expressway. This entrance toll gate lane 1 is partitioned by medians 2 and 3, which are formed in an island and arranged at the two sides thereof, and is given a width to allow an automobile to pass therethrough. A plurality of entrance toll gate lanes 1 are juxtaposed according to the traffic volume.

A vehicle class discriminator 4 is arranged at the most upstream entrance side of the entrance toll gate lane 1. This vehicle class discriminator 4 is composed of a vehicle axle sensor 5 arranged across the entrance toll gate lane 1, and a pair of vehicle height sensors 6 and 7 and a pair of vehicle separators 8 and 9 individually arranged at the medians 2 and 3 to face each other. In this vehicle class discriminator 4, the vehicle separators 8 and 9 detect a vehicle passing through the position of the opposed portions over the entrance toll gate lane 1; the vehicle axle sensor 5 detects the number of steps generated by a vehicle axle for a vehicle detecting period; and the vehicle height sensors 6 and 7 detect the height of the passing vehicle at a predetermined timing using their sensor elements 6*a* and 7*a*.

Thus, the vehicle class discriminator 4 discriminates the vehicle class according to the toll classification on the basis of the height and the axle number, as detected by the individual sensors 5–9, of the passing vehicle. In this case, the vehicles classes are those for providing references which are used when the toll is calculated for the toll road, and are exemplified by the "large class", the "medium class" and the "small class".

A coming vehicle number reader 10 acting as a coming vehicle number recognizer is arranged slightly ahead of the vehicle class discriminator 4. This coming vehicle number reader 10 is composed of a camera 11 and a pair of sensors 12*a* and 12*b* for setting the shot timing of the camera 11. The sensors 12*a* and 12*b* are individually arranged at the medians 2 and 3 to face each other. The sensors 12*a* and 12*b* detect a vehicle passing in between, when their optical axes are interrupted by the vehicle, to cause the camera 11 at that timing to take a shot of the front face including the license plate of the passing vehicle. On the basis of the graphic data taken, moreover, the registered number of the license plate is automatically recognized by pattern recognition technology.

Figure 4:
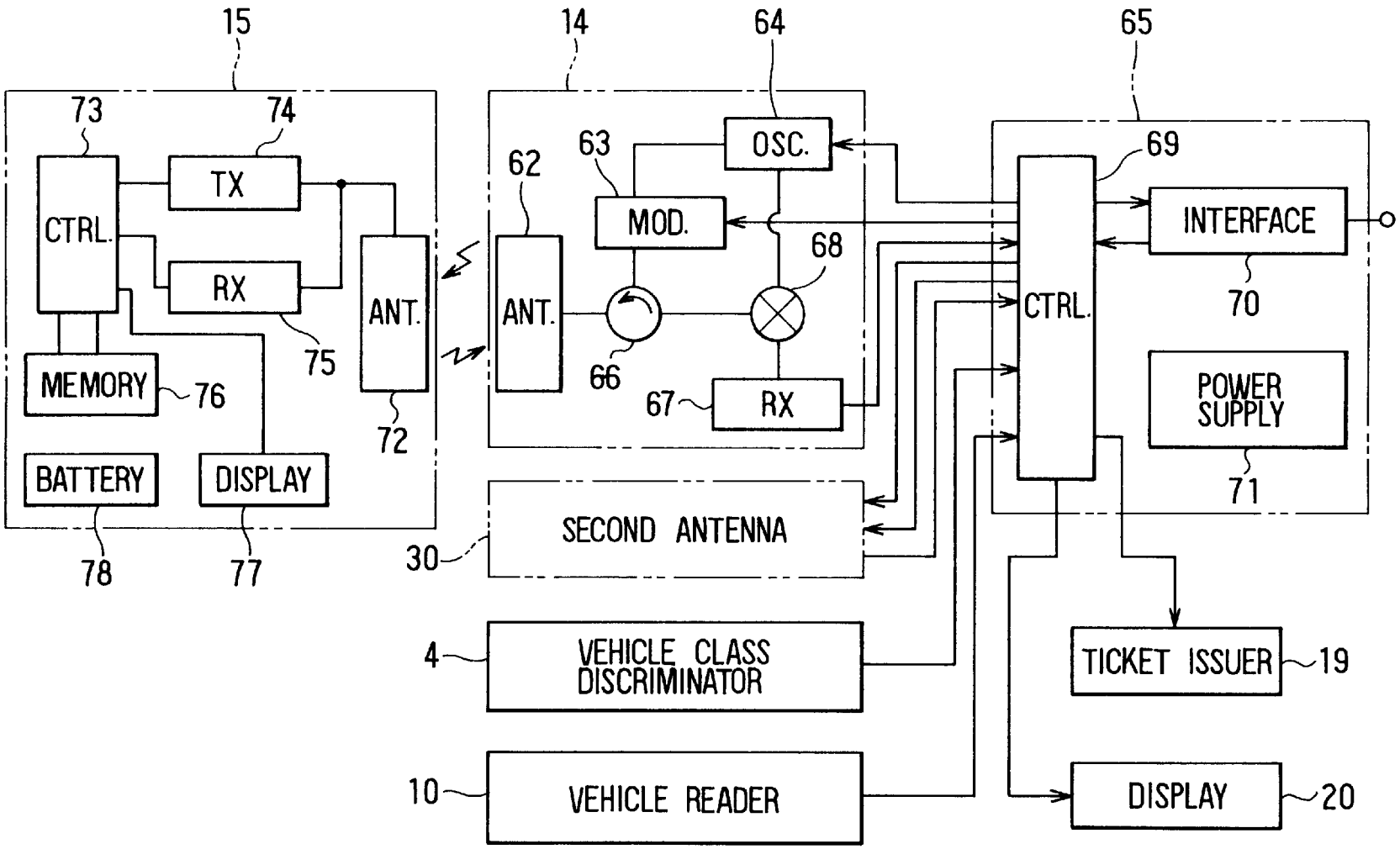
FIG. 4 is a block diagram of a portion of the entrance toll gate side of the first embodiment.

A first gantry 13 in which is arranged a first antenna 14 acting as a first on-road unit is disposed over the vehicle class discriminator 4 and the coming vehicle number reader 10 and across the medians 2 and 3. This first antenna 14 establishes a communication area A1 having a range of a predetermined distance, as taken in the advancing direction from the detection position of the vehicle class discriminator 4. Moreover, the first antenna 14 transmits a pilot signal at a predetermined time interval to the communication area A1 so that it may communicate with an in-vehicle unit 15 (as shown in FIG. 4), as mounted on an ETC vehicle (i.e., a vehicle to be subjected to the ETCS and carrying the unit), when the ETC vehicle comes in the communication area A1.

A first vehicle detector 16 is disposed at the end portion ahead of the communication area A1. This first vehicle detector 16 is composed of a vehicle axle sensor 17 arranged across the entrance toll gate lane 1 and vehicle separators 18*a* and 18*b* individually arranged at the medians 2 and 3 to face each other. Moreover, the first vehicle detector 16 detects the passing vehicles, as separated by the vehicle separators 18*a* and 18*b*, one by one, and detects the passage of the vehicle during the detection period in terms of a detection signal of the vehicle axle sensor 17.

Moreover, the communication area A1 of the first antenna 14 is set such that its size, as taken along the entrance toll gate lane 1, is as long as one ordinary four-wheel automobile, so that it may communicate with only the vehicle passing therethrough. In the case where a plurality of vehicles such as motorcycles come in, reliable communications can be executed by deciding the number of vehicles coming in the communication area A1 by the vehicle class discriminator 4 and the first vehicle detector 16.

A ticket issuer 19 for issuing tickets is arranged at the side closer to the main lanes from the position of the first vehicle detector 16, i.e., at the median 3 a predetermined distance ahead. This ticket issuer 19 is activated, when necessary, to issue a ticket of the class corresponding to the vehicle class discriminated by the vehicle class discriminator 4, as will be described hereinafter. A display unit 20 is arranged in the vicinity and ahead of this ticket issuer 19. This display unit 20 is activated, if necessary, to display an indication asking the driver to receive the ticket.

A second vehicle detector 21 is arranged ahead of the display unit 20. This second vehicle detector 21 is composed, like the first vehicle detector 16, of a vehicle axle sensor 22 and vehicle separators 23 and 24. A start detector 25 is arranged ahead of the second vehicle detector 21 by a predetermined distance. This start detector 25 is composed, like the first and second vehicle detectors 16 and 21, of a vehicle axle sensor 26 and vehicle separators 27 and 28. This start detector 25 is provided for confirming the passage of the vehicle having received the ticket from the ticket issuer 19.

A second gantry 29 is arranged over the start detector 25 and across the entrance toll gate lane 1. A second antenna 30 as a second on-road unit is also arranged over the entrance toll gate lane 1. This second antenna 30 communicates with the in-vehicle unit 15 of the ETC vehicle passing through the entrance toll gate lane 1. The second antenna 30 has a communication area A2 set to a section generally defined by the second vehicle detector 16 and the start detector 25.

Figure 2:
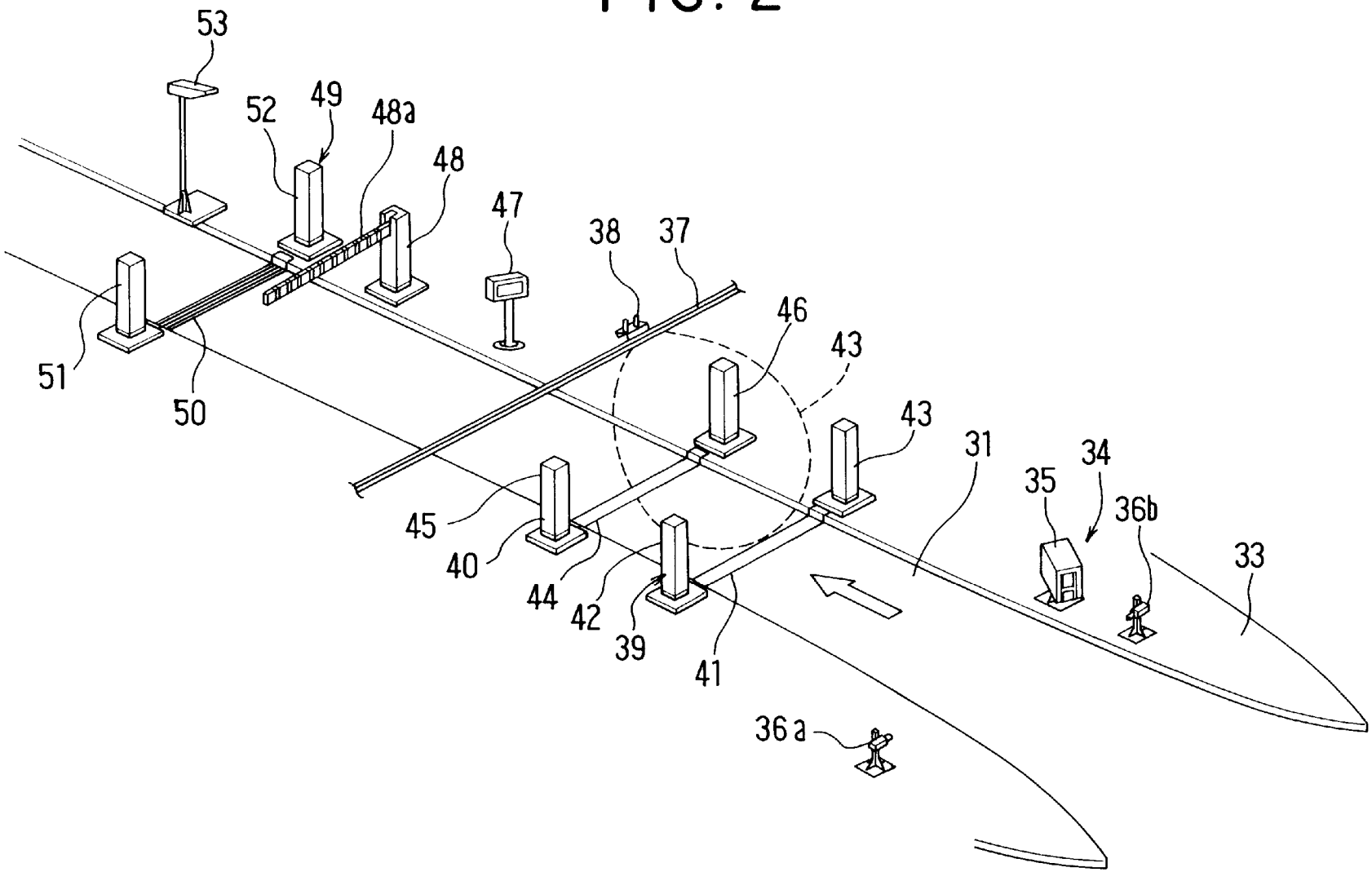
FIG. 2 is a perspective view of an exit toll gate according to the first embodiment.

FIG. 2 shows an arrangement of the individual facilities on an exit toll gate lane 31, which is defined by medians 32 and 33 to have a width allowing only one vehicle to pass therethrough. A leaving vehicle number reader 34 as a leaving vehicle number recognizer is arranged at the closest position of the exit toll gate lane 31 to the main lanes. This leaving vehicle number reader 34 is composed, like the coming vehicle number reader 10, of a camera 35 and sensors 36*a* and 36*b*. Thus, the registered number of the vehicle is recognized by taking a shot of the license plate of the coming vehicle, as detected by the sensors 36*a* and 36*b*.

A third gantry is disposed at a predetermined distance ahead of the leaving vehicle number reader 34 and at a high position. A third antenna 38 acting as a third on-road unit for setting a communication area A3 to communicate with the in-vehicle unit 15 of the ETC vehicle passing through the exit toll gate lane 31 is disposed on this third gantry 37. Vehicle detectors 39 and 40 having constructions similar to the aforementioned ones are arranged at the two end portions of this communication area A3. The vehicle detector 39 is composed of a vehicle axle sensor 41 and vehicle separators 42 and 43, and the vehicle detector 40 is composed of a vehicle axle sensor 44 and vehicle separators 45 and 46 so that they detect the passing vehicle to output their detection signals as before.

At the median 33 a predetermined distance ahead of the third antenna 38, there is arranged a display unit 47, ahead of which is arranged a bascule barrier 48. The display unit 47 displays, when the toll collection fails, an instruction to cause the vehicle to make a stop at the bascule barrier 48. When no stop is required, the bar 48*a* of the bascule barrier 48 is raised to allow the vehicle to pass therethrough.

A start detector 49 which has a construction similar to that of the aforementioned start detector 25 is disposed ahead of the bascule barrier 48. The start detector 49 is composed of a vehicle axle sensor 50 and vehicle separators 51 and 52, and detects a passing vehicle. A stolen-pass preventing camera 53 for taking a front shot of the vehicle which makes a stop at the bascule barrier 48 is disposed at the median 33 in the vicinity of this start detector 49.

Figure 3:
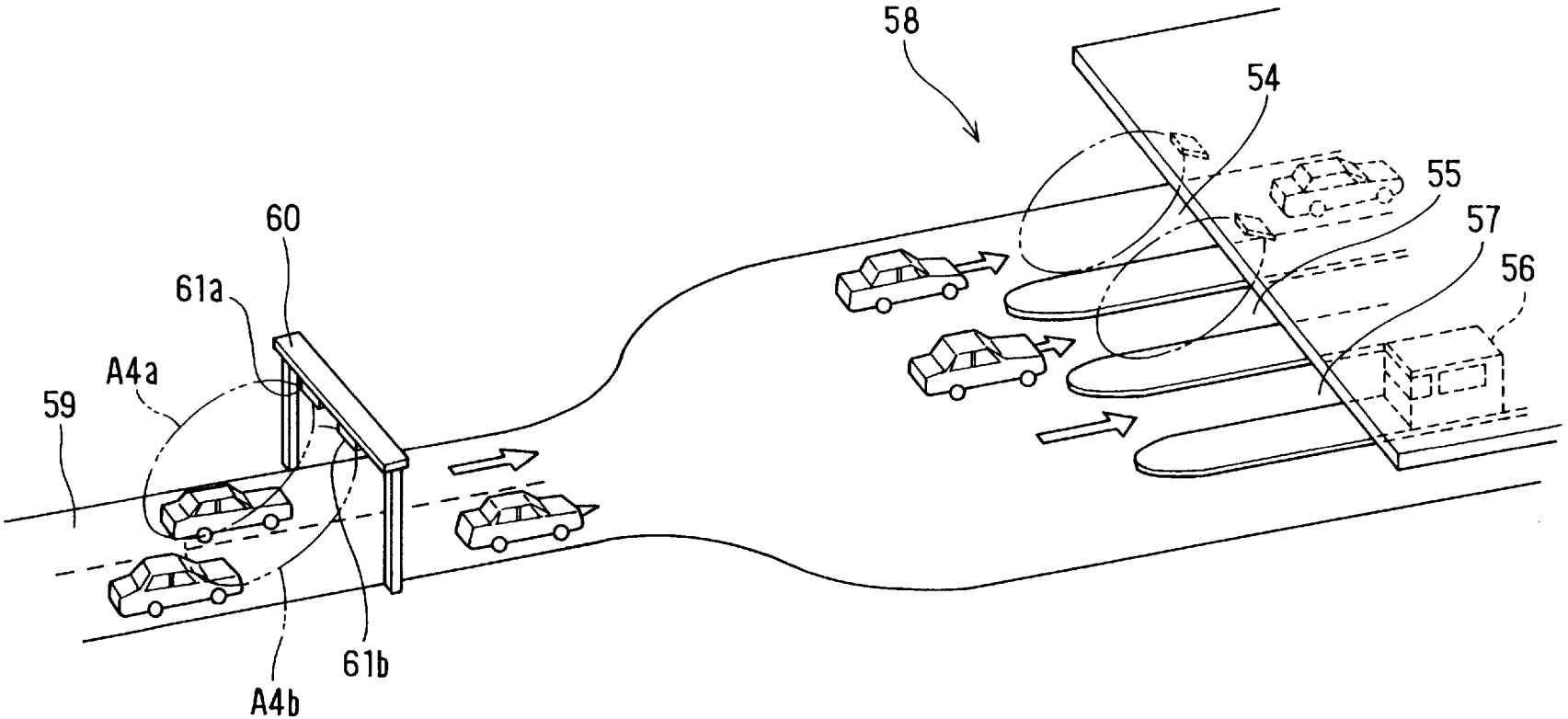
FIG. 3 is a perspective view showing the vicinity of the exit toll gate in the first embodiment.

FIG. 3 presents a perspective view of an exit toll gate 58 and a rampway 59 having two lanes leading from the main lanes (not shown) to the exit toll gate 58. This exit toll gate 58 is provided with two lanes of exclusive exit lanes 54 and 55 of the exit toll gate lane 31, constructed to have the aforementioned facilities, and one manned exit lane 57, constructed to have manned toll collection facilities 56 similar to the prior art.

A fourth gantry 60 which is equipped with fourth antennas 61*a* and 61*b* acting as a fourth on-road unit for setting communication areas A4*a* and A4*b* corresponding to the individual lanes of the rampway 59 is arranged over the rampway 59 immediately before the exit toll gate 58, so that it may communicate with the in-vehicle unit 15 of the ETC vehicle passing therethrough.

FIG. 4 shows a block diagram corresponding to the entrance toll gate. The construction of the first antenna 14 will be described at first. A transmitting antenna 62 employs a patch antenna of micro-strip lines formed over a printed-circuit board, and is constructed of an array antenna in which a plurality of patch antennas are arrayed to improve the directivity and match long-range communications.

A modulator 63 modulates the oscillated output of a predetermined frequency, as fed from an oscillator 64, with an interrogation signal fed from a controller 65 acting as control means. In this case, the oscillator 64 generates the oscillated output of a predetermined frequency the assigned frequency band, for example, 2.45 GHz so that a semi-microwave signal may be outputted as a carrier wave. Incidentally, the antenna 62 is constructed to receive only such a wave of a narrow range selectively as is set to have a predetermined frequency by the oscillator 64.

A receiving circuit 67 for processing or demodulating the signal is connected with a mixer 68, which is fed with the carrier wave from the oscillator 64 and a radio-wave signal corresponding to a response signal from the antenna 62 through the circulator 66. The carrier wave and the radio-wave signal corresponding to the response signal are synthesized by the mixer 68 and then fed to the receiving circuit 67. This receiving circuit 67 demodulates the synthesized signal, as fed, to generate and output a response signal to the controller 65.

Incidentally, the second antenna 30, as connected with the second antenna 30, has the same electrical construction, although not shown. The third antenna 38, as disposed on the exit toll gate lane 31, and the fourth antennas 61*a* and 61*b*, as mounted on the fourth gantry, also have the same electrical construction.

Next, in the controller 65, a control circuit 69 is connected to the modulating circuit 63, the oscillator 64 and the receiving circuit 67, which are disposed in each of the first antenna 14 and the second antenna 30. The controller 65 outputs the interrogation signal at the predetermined timing to the modulating circuit 63 and receives the response signal through the receiving circuit 67. On the other hand, the controller 65 is connected to the vehicle class discriminator 4, the coming vehicle number reader 10, the ticket issuer 19 and the display unit 20 so that it receives the detection signals from the vehicle class discriminator 4 and the coming vehicle number reader 10 and controls the operation of the ticket issuer 19 and the display of the display unit 20.

On the other hand, the control circuit 69 is connected through an interface circuit 70 with the not-shown signal processing unit. A power supplying circuit 71 converts the electric power, as supplied from the not-shown AC power source, into a predetermined DC voltage and supplies it not only to the control circuit 69 and the interface circuit 70 but also to the individual antennas 14 and 30.

On the in-vehicle unit 15, an antenna 72 is a micro-strip antenna formed on a printed-circuit board, and is set to have receivable frequency bands for receiving the signals individually from the first to fourth antennas 14, 30, 38, 61*a* and 61*b*. A control circuit 73 acting as deciding means is composed of a CPU, a ROM and a RAM and constructed to receive the aforementioned interrogation signals in accordance with the program stored in advance and to output the various data such as ID codes as the response signals in accordance with the received signals. This control circuit 73 is connected through a transmitting circuit 74 with the antenna 72 and through a receiving circuit 75 with the antenna 72.

Incidentally, the transmitting circuit 74 performs the transmission by modulating the non-modulated carrier wave, as received by the antenna 72, in accordance with the response signal. The receiving circuit 75 demodulates the radio wave, as received from the antenna 72, and feeds it as the interrogation signal to the control circuit 73. With this control circuit 73, on the other hand, there is connected a data memory 76 as a writable/readable nonvolatile memory. A display unit 77 is provided for displaying data on the communications and is so arranged as can be visually confirmed by the driver. This display unit 77 is used as information means. A battery 78 supply the electric power to the individual circuits in the in-vehicle unit 15. Incidentally, this battery 78 can be replaced by the not-shown in-vehicle battery.

For power economy, the in-vehicle unit 15 is held, at a non-communication time, in a sleep state where it will supply no power to all the circuits including the control circuit 73 other than the receiving circuit 75. In response to the signal from the antenna 72, the in-vehicle unit 15 awakes to supply the electric power, and this wake-up state is continued till the end of the necessary communicating operations. When this communicating operation ends with no received signal, the sleep state is automatically restored after lapse of a constant time period.

The in-vehicle unit 15 is further constructed to receive an IC card for storing the toll collection result. With this IC card being installed, the in-vehicle unit 15 is written by the control circuit 73 on the basis of the toll processing data, as given as a result of the communications.

Next, the operations of the present embodiment will be described with reference to the flowcharts of its individual programs, as shown in FIGS. 5–12. In the following description, the communicating operation is divided into: (a) the communication when the vehicle enters the entrance toll gate lane; (b) the communication in the course of the vehicle progressing from the main lanes to the exit toll gate; and (c) the communication when the vehicle enters the exit toll gate.

For each of these three operations, the following description will be made on the individual cases where the vehicle is an ETC vehicle carrying the in-vehicle unit 15 and where the vehicle is not of this type.

(a) Communication at Entry of Vehicle into an Entrance Toll Gate Lane

Figure 5:
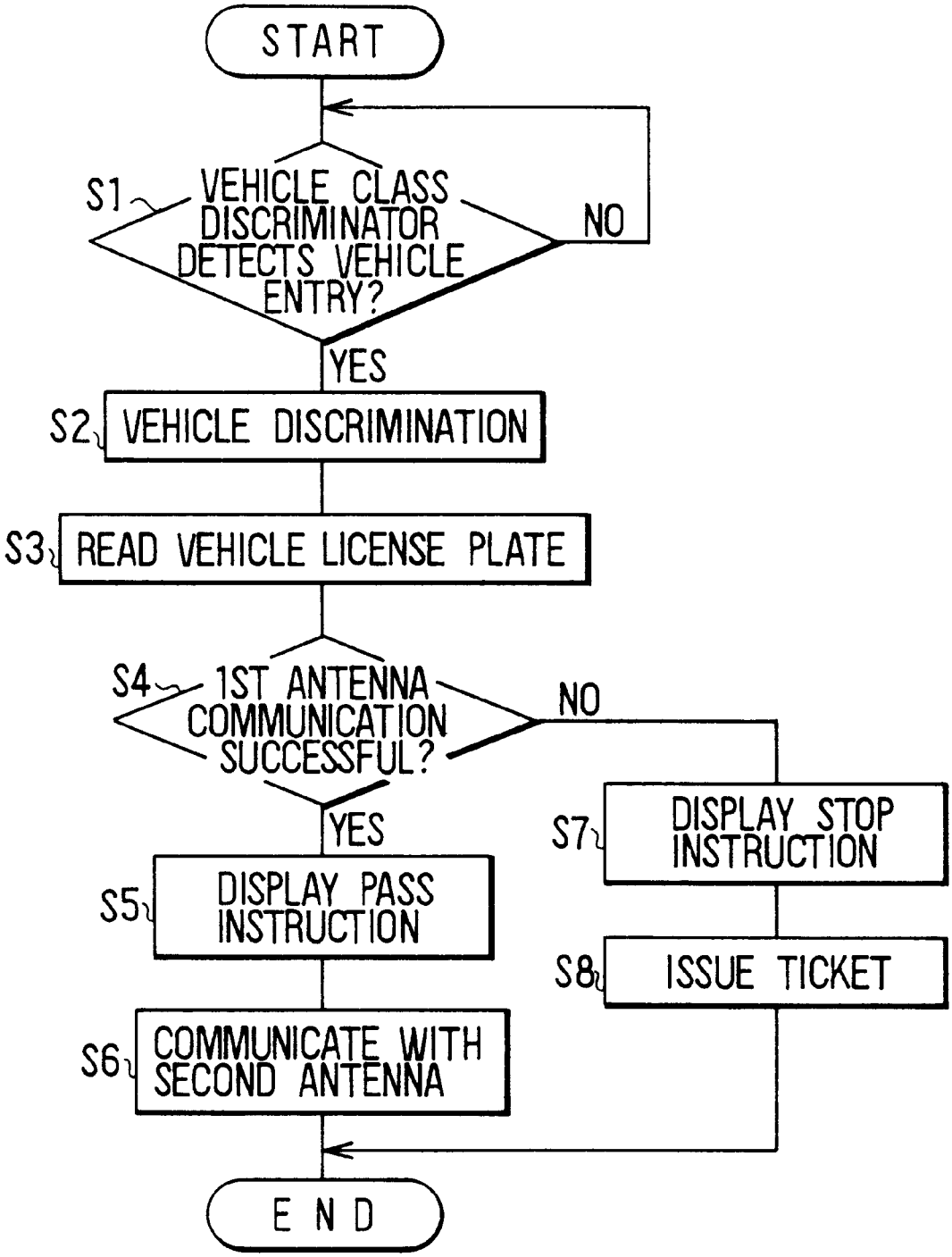
FIG. 5 is a flowchart showing processing of an entrance toll gate lane in the first embodiment.
Figure 6:
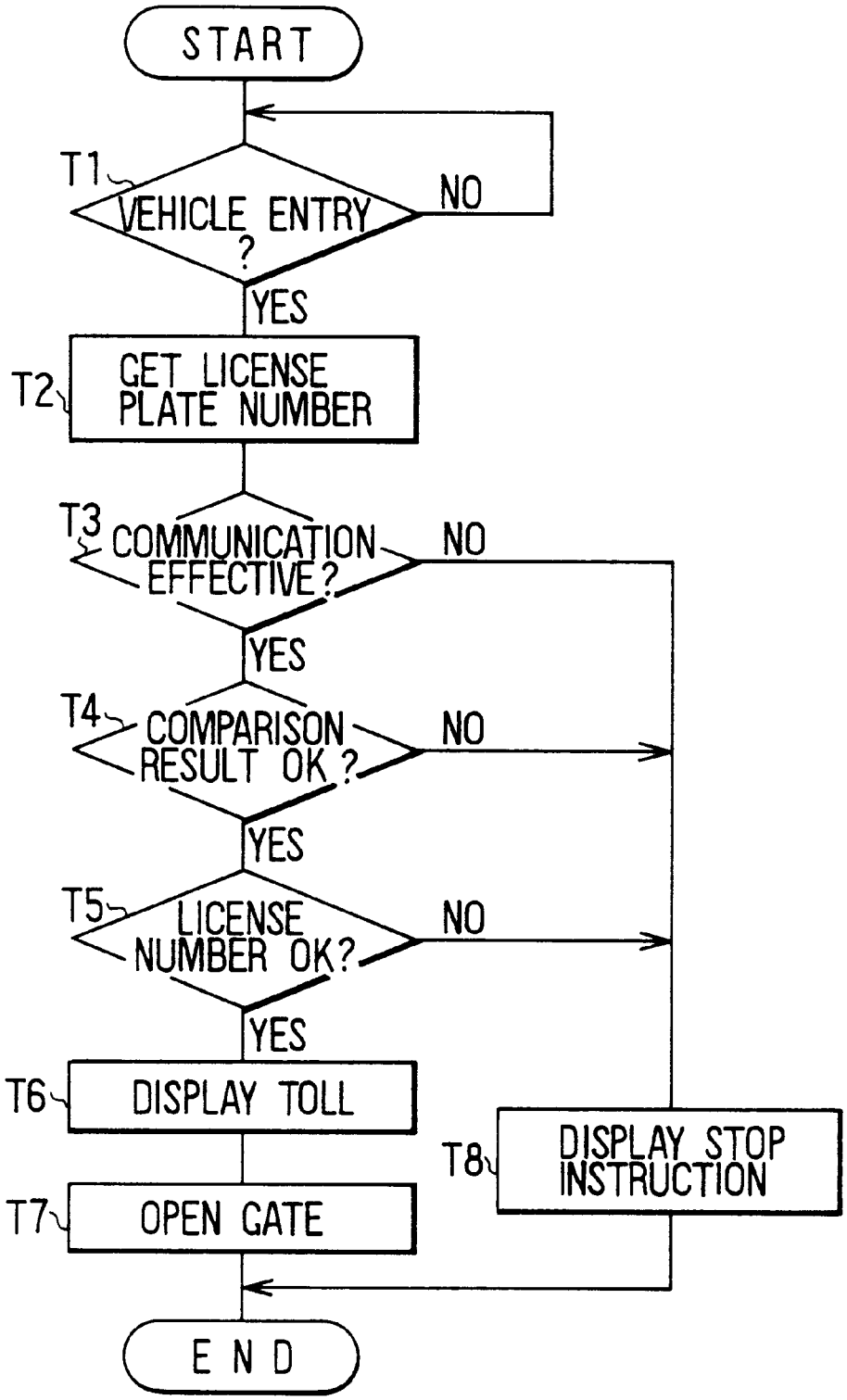
FIG. 6 is a flowchart showing processing of an exclusive lane of the exit toll gate in the first embodiment.
Figure 7:
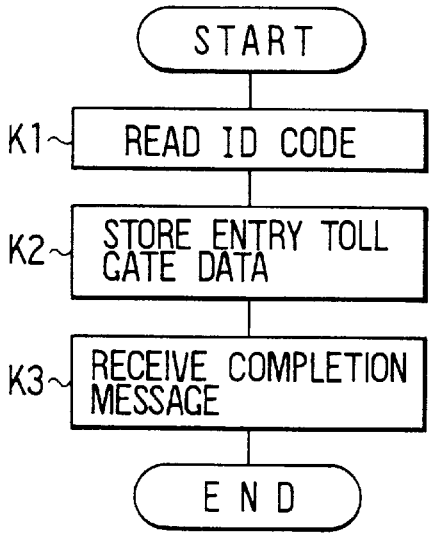
FIG. 7 is a flowchart showing a control program of a first antenna according to the first embodiment.
Figure 8:
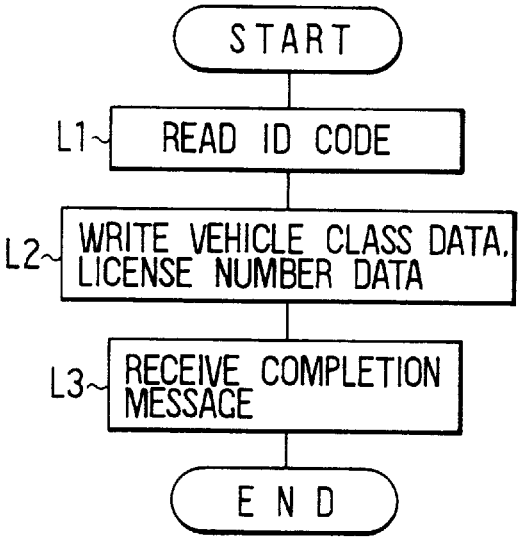
FIG. 8 is flowchart showing a control program of a second antenna according to the first embodiment.
Figure 9:
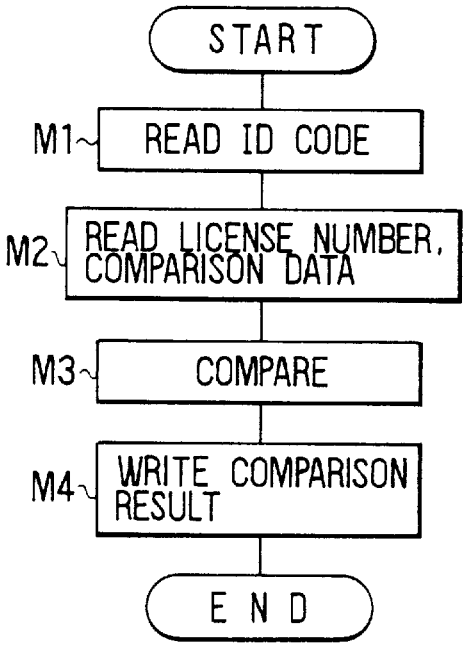
FIG. 9 is a flowchart showing a control program of a third antenna according to the first embodiment.
Figure 11:
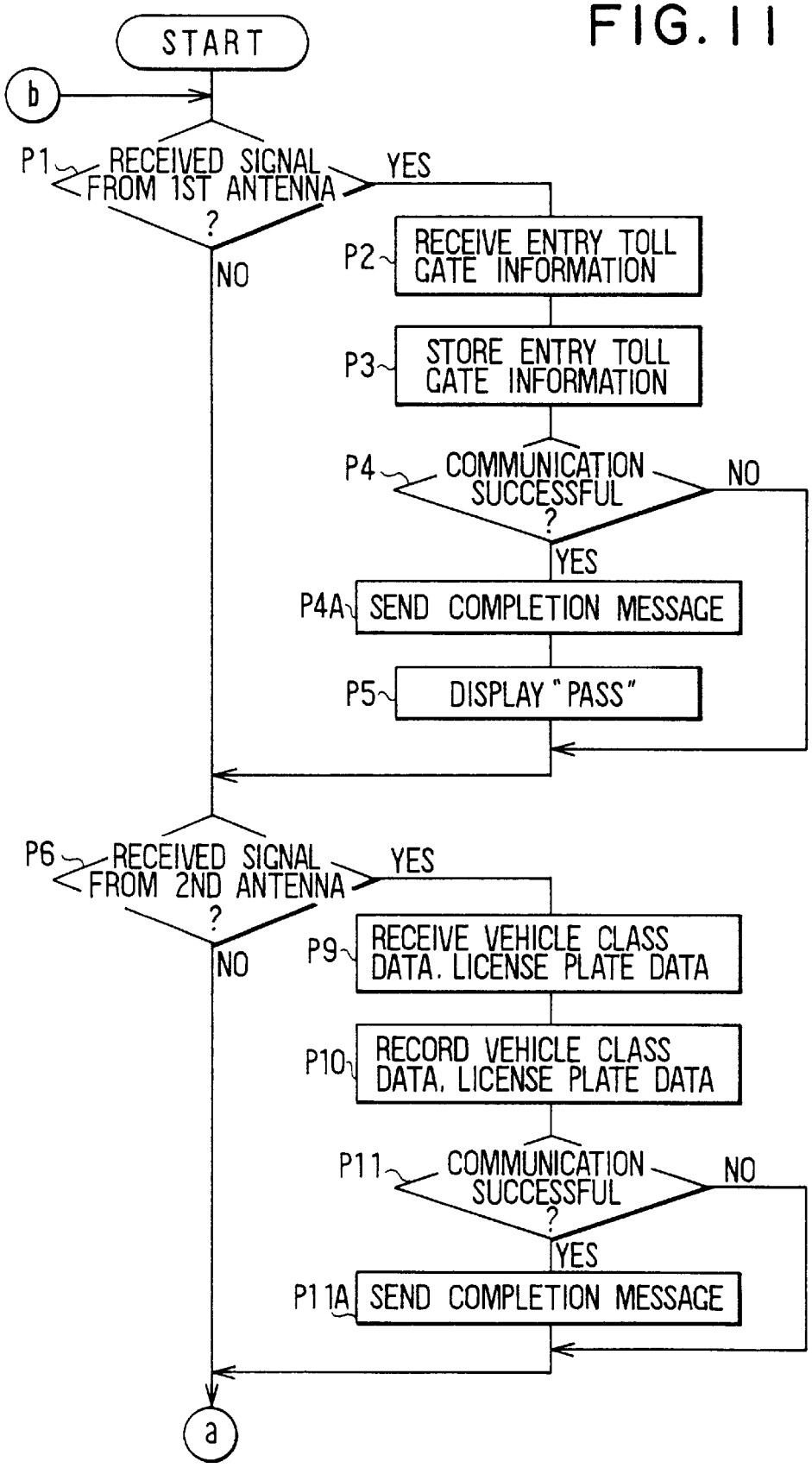
FIG. 11 is a flowchart showing a first part of a control program of an in-vehicle unit according to the first embodiment.
Figure 12:
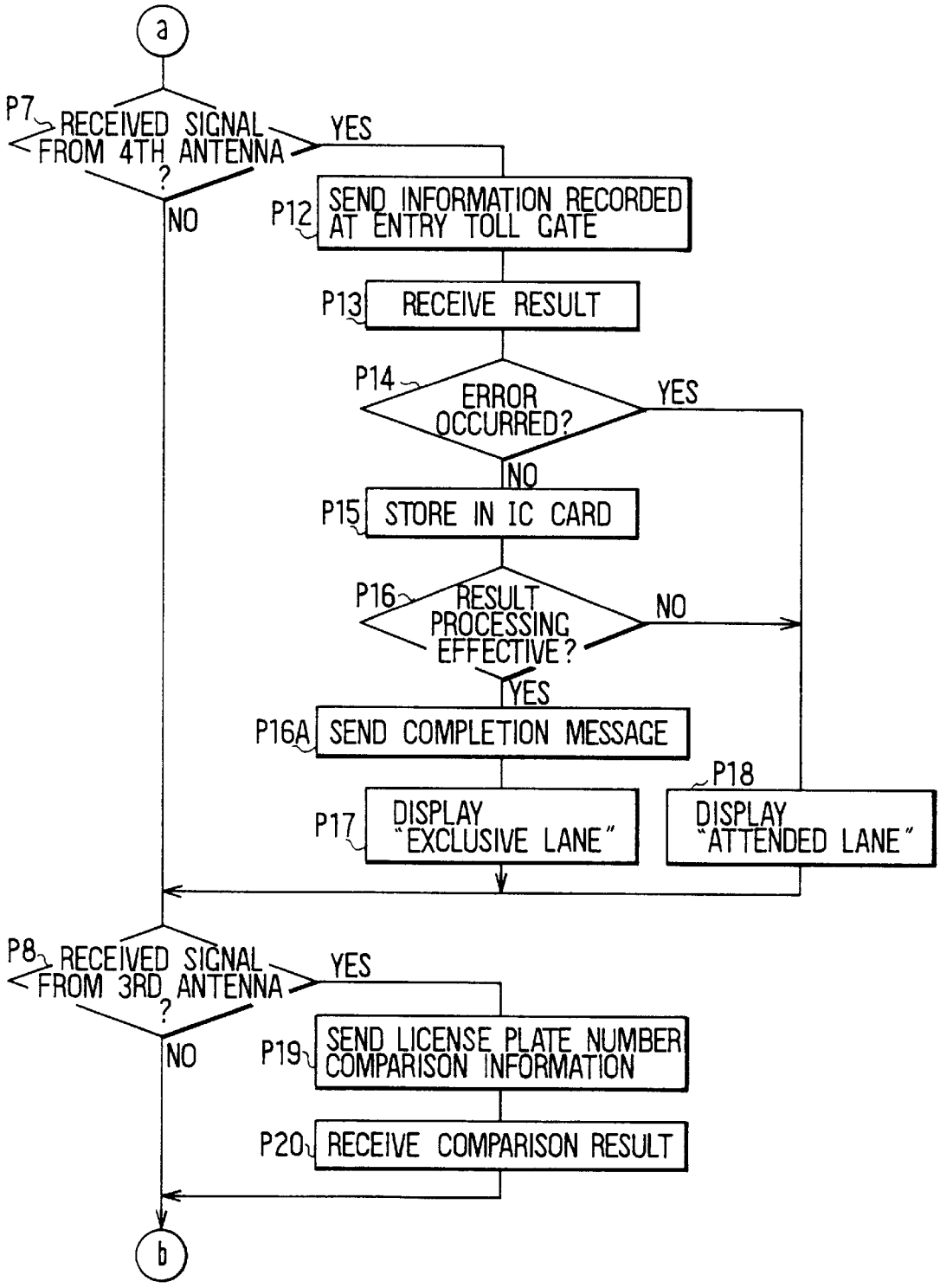
FIG. 12 is a flowchart showing a second part of a control program of the in-vehicle unit.

FIG. 5 shows a processing flow for communications for the toll collection with the in-vehicle unit 15 of the ETC vehicle passing through the entrance toll gate lane 1. Moreover, FIGS. 7 and 8 show control programs for communications between the first and second antennas 14 and 30, as disposed on the entrance toll gate lane 1, and FIGS. 11 and 12 show control programs for the communication control of the in-vehicle unit 15. The operations will be described in accordance with these programs.

In accordance with the flow of FIG. 5, the communications of the case where the vehicle enters the entrance toll gate lane 1 will be described first. When the vehicle enters into the entrance toll gate lane 1 at Step S1, Step S2 discriminates the class of the coming vehicle by the vehicle class discriminator 4. This vehicle class discrimination takes some time (e.g., about 1 second). When the vehicle class is discriminated, that data is transmitted to the controller 65. Subsequently, the shot of the front face of the coming vehicle including the license plate is taken by the coming vehicle number reader 10 to read the registered number at Step S3. Because this step involves pattern recognition, it may take one as much as one second or so. Then, the coming vehicle number reader 10 transmits the registered number data, as read, to the controller 65.

When the coming vehicle is detected by the vehicle separators 8 and 9 of the vehicle class discriminator 4, it enters the communication area A1 of the first antenna 14. In case the coming vehicle is the ETC vehicle carrying the in-vehicle unit 15, it starts the communication with the first antenna 14. In this case, the first antenna 14 transmits not only a pilot signal at a constant time interval for enabling the coming vehicle to communicate without fail but also a non-modulated carrier wave until a next pilot signal is transmitted.

First of all, at the first antenna 14, when the response signal is transmitted from the in-vehicle unit 15 of the coming ETC vehicle in response to the pilot signal being transmitted to the inside of the communication area A1, the ID code, as contained in the response signal, is read out (at Step K1) in accordance with the control program of FIG. 7. Subsequently, the writing operation is executed (at Step K2) to store the entrance toll gate data. In this case, the entrance toll gate data contains the code number of the toll road, the code number indicating the location of the interchange, and so on. After this, from the in-vehicle unit 15, there is transmitted (at Step K3) a message indicating that the entrance toll gate data has been written.

On the other hand, the in-vehicle unit 15 communicates with the first antenna 14 in accordance with the control program shown in FIGS. 11 and 12. In response to the pilot signal from the first antenna 14, as described above, the control circuit 73 comes into the wake-up state to start the program. When the response signal containing the ID code is transmitted in response to the pilot signal, the control circuit 73 determines the answer to be "YES" at Step P1 and executes the communications at and after Step P2.

The control circuit 73 of the in-vehicle unit 15 receives the entrance toll gate data transmitted from the first antenna 14, through the antenna 72 and the receiving circuit 75 (at Step P2), and stores the received entrance toll gate data in the data memory 76 (at Step P3). Next, it is confirmed that the data, as obtained by the reception, has no errors and that the communication has succeeded. In other words, it is confirmed (at Step P4) that the entrance toll gate data are accurately written. When the communication succeeds, an end message indicating the success is transmitted (at Step P4A).

Since no pass need be received at the toll gate, an indication of "Pass" is made (at Step P5) at the not-shown display unit 77 disposed near the driver's seat. The driver can recognize that the communication has succeeded and pass through the ticket issuer 19 by confirming that indication visually. After this, the control circuit 73 returns again to Step P1 through Steps P6 to P8. In the event of failure of the communication, the operations of Steps P1 and P6 to P8 are repeated.

In case, on the other hand, the in-vehicle unit 15 has failed for some reason to communicate on the toll gate data transmitted from the first antenna 14, the answer "NO" is determined at Step P3, and the routine skips to Step P6.

Now, when the communication by the first antenna 14 is normally executed, the controller 65 causes the display unit 20 to indicate "Pass" thereby to request the driver of the coming ETC vehicle to pass through the ticket issuer 19 (at Steps S4 and S5 of FIG. 5). Subsequently, the controller 65 outputs the control signal to cause the second antenna 30 to communicate (at Step S6).

The second antenna 30 starts the communication in accordance with the control program shown in FIG. 8. When the response signal is transmitted from the in-vehicle unit 15 of the coming ETC vehicle in response to the pilot signal being transmitted to the inside of the communication area A2, the ID code contained in the response signal is read out at Step L1. Subsequently, the vehicle class data read by the vehicle class discriminator 4, and the registered number data read by the coming vehicle number reader 10 are written (at Step L2) so that they may be stored in the in-vehicle unit 15. After this, an end message indicating the writing of the registered number data is transmitted (at Step L3) from the in-vehicle unit 15.

As a result, not only the toll gate data but also the vehicle class data and the registered number data can be stored in the vehicle advancing to the main lanes. When the communication by the controller 65 with the in-vehicle unit 15 of the coming ETC vehicle ends, the processing at the entrance toll gate lane 1 ends.

In this case, according to the aforementioned control program of FIGS. 11 and 12, the control circuit 73 of the in-vehicle unit 15 receives the pilot signal, as transmitted from the second antenna 30 like before, and transmits the response signal containing the ID code. At subsequent Step P6, the answer "YES" is decided, and the routine transfers to Step P9.

The control circuit 73 of the in-vehicle unit 15 receives (at Step P9) the vehicle class data and the registered number data, as transmitted from the second antenna 30, through the antenna 72 and the receiving circuit 75 and stores (at Step P10) the vehicle class data and the registered number data received, in the data memory 76. Next, it is confirmed that no error is in the received data so that the communication has succeeded. In other words, it is confirmed (at Step P11) that the registered number data are accurately written. In the case of success in the communication, the end message indicating the same is transmitted (at Step P11A). After this, the routine transfers to Step P7. Then, the ETC vehicle carrying the in-vehicle unit 15 advances to and runs on the main lanes so that the communication is not made for a while. Moreover, the in-vehicle unit 15 is in the sleep state for this time period.

In case of failure of the communication, as described above, that is, when the coming vehicle does not carry the in-vehicle unit 15 or when even the ETC vehicle cannot for some reason make the communication, the controller 65 recognizes it from the failure of the communication of the first antenna 14. In this case, moreover, the controller 65 causes the display unit 20 to display the stop instruction (at Step S7) so that the coming vehicle may once stop at the position of the ticket issuer 19, and then causes the ticket issuer 19 to issue a ticket corresponding to the vehicle class, as discriminated by the vehicle class discriminator 4.

(b) Communication in the Course of Vehicle Travel from Main Lanes to Exit Toll Gate Next, when the vehicle leaves the main lanes to the rampway, it passes through the communication area A4*a* or A4*b* of either the fourth antenna 61*a* or 61*b* before it enters the exit toll gate lane 31. In this passage, the vehicle communicates with the corresponding fourth antenna 61*a* or 61*b*.

Figure 10:
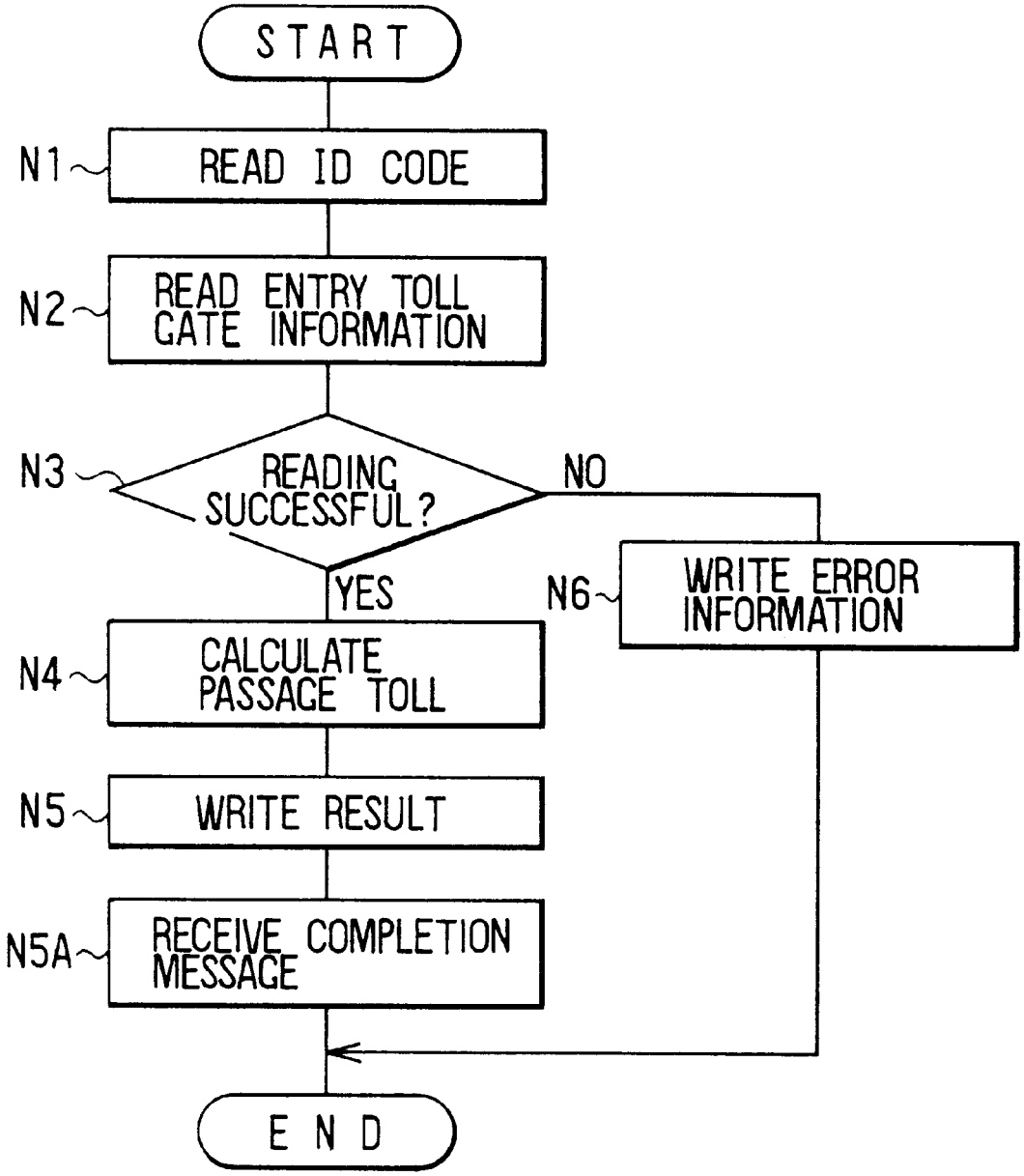
FIG. 10 is a flowchart showing a control program of a fourth antenna according to the first embodiment.

The fourth antennas 61*a* and 61*b* transmit the pilot signals intermittently into the interior of the communication areas A4*a* and A4*b*. When the in-vehicle unit 15 of the coming ETC vehicle receives either of the pilot signals, it transmits the response signal containing the ID code. This response signal is received, and the control program of FIG. 10 is started.

First of all, the fourth antenna 61*a* or 61*b* reads the ID code of the in-vehicle unit 15 (at Step N1), and communicates (at Step N2) with the in-vehicle unit 15 for reading out the entrance toll gate data written by the first antenna 14 at the entrance toll gate, and the vehicle class data written by the second antenna 30. When the reading of this data is successful (at Step N3), the toll to this exit toll gate is calculated (at Step N4) on the basis of the read data. The calculated result is transmitted as the toll data to the in-vehicle unit 15 (at Step N5) for the toll collection. After this, the end message, as transmitted from the in-vehicle unit 15, is received (at Step N5A).

In case the aforementioned reading of the data from the in-vehicle unit 15 fails (at Step N3), the fourth antenna 61*a* or 61*b* transfers to Step N6, at which the failure in the reading is processed as error data, and communicates to cause the in-vehicle unit 15 to write the error data.

In the communication from the fourth antenna 61*a* or 61*b*, on the other hand, the control circuit 73 in the in-vehicle unit 15 comes into the wake-up state in response to the received pilot signal to start the communication in accordance with the control program of FIG. 12. Then, the control circuit 73 transmits the response signal containing the ID code and starts the control program, in which the answer "YES" is decided at P7 through Steps P1 and P6, and the routine transfers to Step P12.

In response to the request signal from the fourth antenna 61*a* or 61*b*, the control circuit 73 of the in-vehicle unit 15 reads and transmits (at Step P12) the data written by the first antenna 14 and the second antenna 30 of the entrance toll gate lane 1. Subsequently, the control circuit 73 receives (at Step P13) the toll collection data calculated by the fourth antenna 61*a* or 61*b*, and writes the received toll collection data in the IC card (at Step P15) when no error occurs in the toll collection (at Step P14).

When it is confirmed (at Step P16) that the toll collection data are written in the IC card, the control circuit 73 transmits the end message indicating the writing (at Step P16A) to cause the display unit 77 disposed near driver's seat, to display the "the exclusive lane" (at Step P17) thereby requesting the driver to advance to the exclusive lane 54 or 55 of the exit toll gate 58. In the case of a failure to receive the toll collection data (at Step P14) or to write the IC card (at Step P16), on the other hand, the control circuit 73 causes the display unit 77 to display the "manned lane" thereby requesting the driver to advance to the manned lane 57 of the exit toll gate 58.

(c) Communication at Entry of Vehicle into Exit Toll Gate

Here will be described the operations of the case where the coming vehicle enters the exclusive lane 54 to 55 of the exit toll gate 58. Incidentally, the facilities to be provided at the exclusive lanes 54 and 55 are identical to those of the exit toll gate lane 31, as shown in FIG. 2, and the communications are executed according to the processing flow shown in FIG. 6.

As the aforementioned vehicle comes to the leaving vehicle number reader 34 of the exit toll gate lane 31, its entry is detected (at Step T1), and a shot of its license plate is taken to start the detection of the registered number (at Step T2). As the coming vehicle enters the communication area A3 of the third antenna 38, this antenna 38 communicates according to the control program shown in FIG. 9.

When the response signal is transmitted from the in-vehicle unit 15 of the coming ETC vehicle in response to the pilot signal being transmitted to the interior of the of the communication area A3, the third antenna 38 reads the ID code, as contained in the response signal, (at Step M1). Subsequently, the third antenna 38 communicates to read (at Step M2) the registered number data and the identification data, as stored in the in-vehicle unit 15, and executes the identification (at Step M3) on the basis of the data obtained. After this, the third antenna 38 communicates to write the identification result in the in-vehicle unit 15.

For these communications, when the control circuit 73 of the in-vehicle unit 15 decides the answer "YES" at Step P8 in accordance with the control program of FIG. 12, it transfers to Step P19, at which it reads and transmits the registered number data and the identification data, as stored therein, in response to the request signal transmitted from the third antenna 38. After this, the control circuit 73 ends its communications by receiving the data of the identification result transmitted from the third antenna 38.

Thus, the communications between the in-vehicle unit 15 of the coming ETC vehicle and the third antenna 38 end. When the communications are normal (at Step T3 of FIG. 6) and when the decisions are OK on both the identification result of the toll collection data and the identification result between the registered number data, as read from the in-vehicle unit 15, and the registered number data, as read from the leaving vehicle number reader 34 (at Steps T4 and T5), the toll is displayed in the display unit 47 (at Step T6), and it is instructed (at Step T7) to open the barrier bar 48*a* of the bascule barrier 48.

In case any of the answers of Steps T3 to T5 is "NO", the communications fail somewhere, and then the toll collection is necessary so that the display unit 47 is caused to display the "instruction to stop" (at Step T8) thereby leaving the bascule barrier 48 closed. As a result, the coming vehicle is blocked from passing by the bascule barrier 48. At this time, a shot of the front portion of the coming vehicle is taken and recorded together with the driver by the stolen-pass preventing camera 53. On the other hand, the vehicle instructed to enter the manned exit lane 57 is allowed to pass after it once stops to pay the toll at the toll collection facilities of the manned exit lane 57.

The following effects can be achieved according to the present embodiment thus far described.

Firstly, on the entrance toll gate lane 1, the class and the registered number of the coming vehicle are discriminated and recognized by the vehicle class discriminator 4 and the entrance vehicle number reader 10. In case the coming vehicle is an ETC vehicle, the entrance toll gate data are written in the in-vehicle unit 15 by the first antenna 14. In the case of the ETC vehicle, therefore, the data on the entrance toll gate can be stored without stopping the ETC vehicle at the entrance toll gate.

Secondly, although the vehicle class discriminator 4 and the start detector 25 of the prior art are used as they are, there can be additionally made another construction capable of executing the communications reliably for the ETC vehicle, and the pass can be received from the ticket issuer 19 even when the coming vehicle is not the ETC vehicle.

Thirdly, by the fourth antenna 61*a* or 61*b* disposed midway to the exit toll gate, the toll to the exit toll gate can be calculated in advance to cause the in-vehicle unit 15 to execute the toll collection so that a reliable toll collection can be executed for the time period until the exit toll gate lane 31 is reached. When the toll collection of the in-vehicle unit 15 is improper, the coming vehicle can be guided to the manned exit lane.

Fourthly, at the exit toll gate lane 31, 54 or 55, due to the in-vehicle unit 15 carried by the ETC vehicle and the third antenna, it is possible to confirm whether or not the toll collection data are reliably written in the IC card by the in-vehicle unit 15. When this writing is not executed, the ETC vehicle can be stopped by the bascule barrier 48, and its shot can be taken by the stolen-pass preventing camera 53, so that the toll collection can be reliably executed even when the writing fails.

Fifthly, the passing vehicle can be confirmed by identifying the registered number of the coming vehicle, as read by the leaving vehicle number reader 34, and the registered number, as read by the entrance vehicle number reader 10 and written in the in-vehicle unit 15 by the second antenna 30. As a result, the vehicle having run from the entrance toll gate to the exit toll gate and its in-vehicle unit 15 can be identified. This makes it unnecessary to take the using mode, in which the in-vehicle unit 15 is limited to a specific vehicle, so that flexible operations can be performed. Moreover, an anomalous condition, in which the in-vehicle units 15 are exchanged in the course of passage on the toll road, can be inspected at the exit toll gate.

Figure 13:
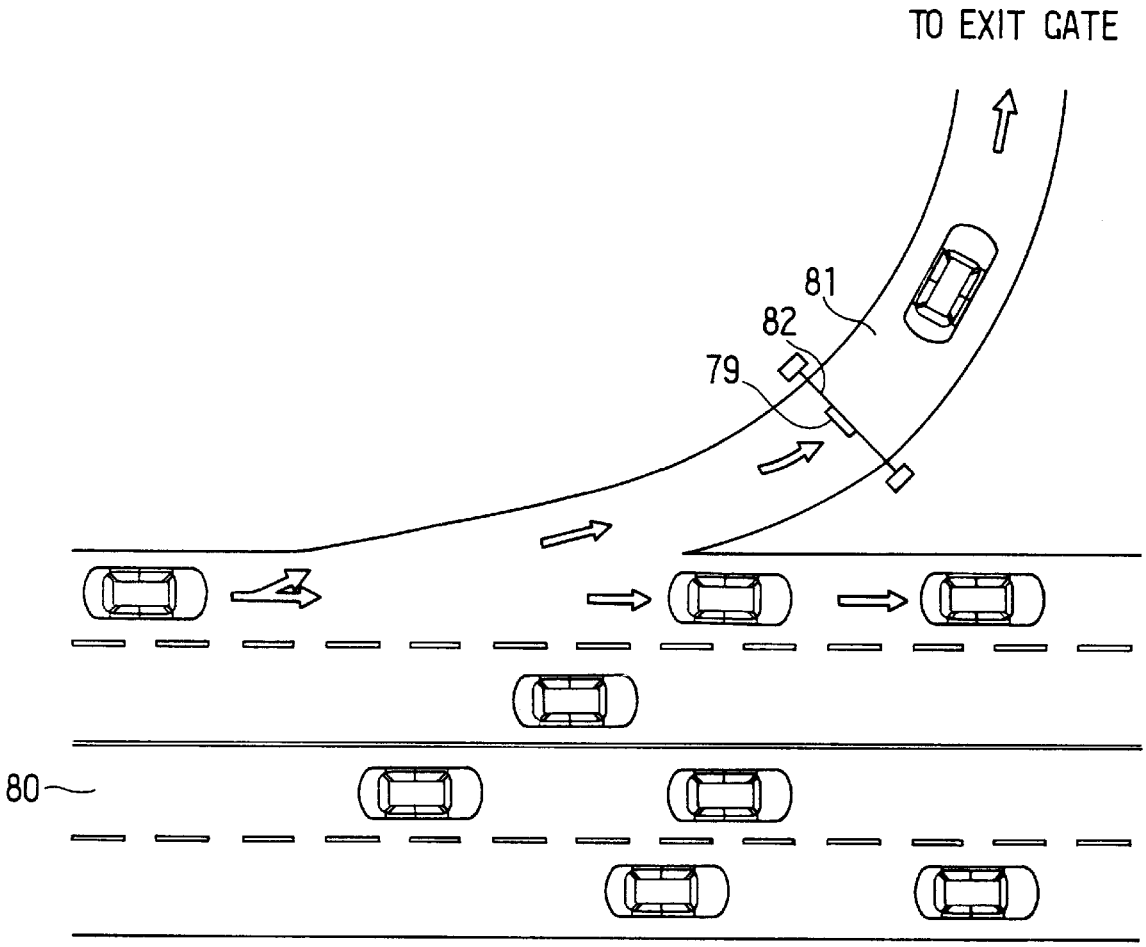
FIG. 13 is a view similar to FIG. 3 but showing a second preferred embodiment of the present invention.

FIG. 13 shows a second preferred embodiment of the present invention, which is different from the first embodiment in that a fourth antenna 79 corresponding to the fourth antennas 61*a* and 61*b* is mounted on a gantry 82 which is arranged on a rampway 81 leading from main lanes 80 to the exit toll gate. By this construction, too, there can be achieved operational effects similar to those of the first embodiment.

The present invention should not be limited to the foregoing embodiments but can be modified or expanded in the following manners.

The vehicle class discriminator is commonly used among the sensors for setting the end portions of the communication areas, but the construction may be modified such that an exclusive vehicle detecting sensor is separately provided.

The first to fourth on-road units (or antennas) may be mounted on not only the gantries but also on the lower sides of the roofs of the toll gates.

The fourth antenna can be provided, if necessary. In this modified construction, the communications of the fourth antenna are executed by the third antenna.

The bascule barriers and the stolen-pass preventing camera may also be provided, if necessary.

Various other changes and modifications will become apparent to those skilled in the art. Such changes and modifications are to be understood as being included within the scope of the present invention as defined by the appended claims.

What is claimed is:

1. A toll collection system on a toll road for collecting a toll of a vehicle passing through the toll road, the toll collection system comprising:

a first on-road unit, disposed at a vehicle entry position on an entrance toll gate lane of the toll road, for transmitting entrance toll gate data to an oncoming vehicle and confirming whether communication of the system with an in-vehicle unit of the vehicle has succeeded;

a vehicle class discriminator for discriminating a class of the vehicle for calculating a toll of the vehicle and generating vehicle class discrimination data representative thereof when passing the first on-road unit;

a ticket issuer, disposed on the entrance toll gate lane downstream from both the vehicle class discriminator and the first on-road unit relative to a vehicle movement direction, for issuing a ticket corresponding to the class discriminated by the vehicle class discriminator; and a second on-road unit arranged on the entrance toll gate lane downstream from the ticket issuer in the vehicle movement direction, for transmitting the vehicle class data discriminated by the vehicle class discriminator to the in-vehicle unit.

2. The system of claim 1, further comprising control means for controlling the second on-road unit to transmit the vehicle class data when successful communication between the in-vehicle unit and the first on-road unit has occurred, and for controlling the ticket issuer to issue the ticket when successful communication between the in-vehicle unit and the first on-road unit has not occurred.

3. The system of claim 2, further comprising:

a coming vehicle number recognizer for recognizing a registered number of a license plate of the vehicle as it enters the entrance toll gate lane and generating coming registered number data representative thereof;

wherein the control means is for causing the second on-road unit to transmit the vehicle class data and the registered number as recognized by the coming vehicle number recognizer to the in-vehicle unit.

4. The system of claim 2, further comprising:

a display unit disposed on the entrance toll gate lane downstream from the first on-road unit and the vehicle class discriminator in the vehicle movement direction;

wherein the control means is for, when it causes the ticket issuer to issue the ticket, causing the display unit to display a request to a driver of the vehicle to take the ticket.

5. The system of claim 1, further comprising a third on-road unit, disposed at an exit toll gate lane of the toll road, for performing toll-related communication with the vehicle.

6. The system of claim 5, further comprising:

a leaving vehicle number recognizer for recognizing a registered number of a license plate of a vehicle entering the exit toll gate lane of the toll road and generating leaving registered number data representative thereof;

wherein the third on-road unit is for comparing the coming registered number data with the leaving registered number data.

7. The system of claim 1, wherein the second on-road unit is disposed on the entrance toll gate lane downstream from the first on-road unit, the vehicle class discriminator and the ticket issuer in the vehicle movement direction.

8. The system of claim 1, further comprising a fourth on-road unit disposed on an admission passage from main lanes of the toll road to the exit toll gate lane, for executing toll calculation with the vehicle and for instructing writing of a result of the calculation in the in-vehicle unit.

9. The system of claim 8, further comprising:

decision means for deciding whether the writing is executed in response to an instruction received from the fourth on-road unit; and information display means for informing a driver of the vehicle of a decision result of the decision means.

10. The system of claim 1, wherein the vehicle class discriminator is disposed upstream from the first on-road unit in the vehicle movement direction.

* * * * *